US006603953B2

(12) United States Patent
Jewell

(10) Patent No.: US 6,603,953 B2
(45) Date of Patent: Aug. 5, 2003

(54) NIPPED ROLLERS FOR CENTERING IMAGES ON SHEET MEDIA

(75) Inventor: Robert W. Jewell, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 91 days.

(21) Appl. No.: 10/017,803

(22) Filed: Dec. 14, 2001

(65) Prior Publication Data

US 2003/0113149 A1 Jun. 19, 2003

(51) Int. Cl.[7] ..... G03G 15/00
(52) U.S. Cl. ..... 399/395; 271/227; 324/701
(58) Field of Search ..... 399/395; 400/579; 101/481, 485; 271/226–228; 358/1.12, 1.18; 324/699, 701

(56) References Cited

U.S. PATENT DOCUMENTS

| | | | | |
|---|---|---|---|---|
| 3,323,699 A | * | 6/1967 | Bricker, Jr. | 226/15 |
| 3,541,437 A | * | 11/1970 | Ahrweiler | 324/699 |
| 4,641,949 A | * | 2/1987 | Wallace et al. | 399/390 |
| 5,031,896 A | * | 7/1991 | Winkler | 271/258.04 |
| 5,458,324 A | | 10/1995 | Nakamura et al. | |
| 5,676,477 A | | 10/1997 | Tanaka et al. | |
| 5,857,130 A | | 1/1999 | Ueda et al. | |
| 5,887,996 A | | 3/1999 | Castelli et al. | |
| 6,160,608 A | | 12/2000 | Kimura | |
| 6,234,694 B1 | | 5/2001 | Brookner | |
| 6,241,334 B1 | | 6/2001 | Haselby | |
| 6,273,418 B1 | | 8/2001 | Fujikura et al. | |

FOREIGN PATENT DOCUMENTS

| | | | | |
|---|---|---|---|---|
| JP | 63227364 A | * | 9/1988 | B41J/13/00 |
| JP | 05116805 A | * | 5/1993 | B65H/7/08 |

* cited by examiner

*Primary Examiner*—Robert Beatty

(57) ABSTRACT

A sheet media position sensor device is disclosed which incorporates a pair of opposed nipped rollers positioned laterally across a sheet media transport path. One roller is electrically conductive while the opposed roller has an electrically conductive resilient coating. The coated roller is insulated at its mid point to divide the coating on the roller into two halves. A DC voltage is applied to the electrical conductive roller with current passing equally through each half of the adjacent coated roller. As sheet media is passed along the transport path and between the two nipped rollers, the sheet media acts as an insulator to reduce the actual contact area and therefore, the current flow between the conductive roller and the coated halves of the nipped roller. This reduced current flow is directly proportionate to the remaining contact area for each half of the roller which specifically identifies the lateral position of the sheet media. A plurality of current readings at predetermined time intervals produce multiple output signals which identifies the position of the sheet with respect to the center line of the transport path. These output signals can be used to realign and register a print image as it is applied to the sheet media.

15 Claims, 4 Drawing Sheets

NIPPED ROLLERS FOR CENTERING IMAGES ON SHEET MEDIA

RELATED APPLICATIONS

BACKGROUND OF THE INVENTION

1. Field of the Invention

The present invention relates to a sheet media position sensing device for an image producing apparatus, such as a laser printer. It is more specifically directed to a sheet media position sensor for registering the printed image with the sheet media.

2. Discussion of the Background

In an image forming apparatus, such as a laser printer, a sheet media feeder is provided for transporting the individual sheets into substantial alignment with a xerographic printing device.

In most printing apparatus of this type a sheet media storage tray is mechanically positioned to register the sheet media as it is fed into the mechanism in proper alignment with a transport path to the image producing device. Thus, mechanically the sheet media is properly aligned by the storage tray with respect to both the transport path and the print producing apparatus. A suitable mechanism, such as a sheet feeder roller, is employed in relation to the storage tray to feed a single sheet of the media from the tray into nipped rollers provided along the transport path of the sheet. The feed roller and nipped rollers move the sheet media as accurately as possible, but in many cases the sheet becomes skewed or shifted with respect to the center line of the transport path, which places the sheet media out of proper position with respect to the image producing portion of the printing apparatus.

Up to now, the primary way of attempting to correct this condition is to provide some kind of mechanical apparatus along the transport path to reposition the sheet media into an accurate position required for the image transfer. In the past, individual rollers set laterally with respect to the transport path or individual positioning rollers along the path which can be arranged perpendicular to the longitudinal axis of the path or skewed at an angle with respect to the path have been provided. Various types of sensors, such as photoelectric detectors have been provided in the transport path to determine the position of the sheet media. It is necessary to not only measure the position of the sheet media laterally with respect to the center line of the transport path but also with respect to whether it is skewed with respect to that axis. Once this measurement has been taken and the position calculated the mechanical correction systems, such as the lateral rollers or individual rollers, are rotated at different velocities in an attempt to return the sheet media to the proper position prior to being fed into the image producing device.

Thus, this method produces a sheet alignment mechanism for correcting the positional shift in the sheet media during transportation which is usually caused by rollers which are misapplied or worn within the sheet transporting mechanism. These types of correction devices usually include one of two different types of registration systems. One system is a "lead" registration reference in which the posture or position of the sheet media is realigned with respect to the leading edge of the sheet, and the second registration system is a "side" registration reference in which the position of the sheet is realigned with respect to the side edge of the sheet media. With the first system, a lateral gate is usually positioned across the transport path so that the sheet media as it moves along the transport path will be stopped momentarily by the lateral gate to reposition the sheet properly with respect to the image producing device. The second registration system causes the sheet to move laterally so as to register the side of the sheet against a fixed elongated member which aligns the sheet with respect to the proper transport path and the image producing device.

The problems with these systems are that with the leading edge registration the sheet is caused to abut and temporarily stop to finalize the correct position of the sheet media. The side registration does not always function properly in that the side of the sheet may buckle preventing the sheet from becoming properly aligned with the respect to the imaging device. This is especially true when the thickness of the sheet media is quite thin and provides little strength or rigidity for the alignment process.

In other prior art, small individual rollers are used at various locations along the transport path and once the position of the sheet is determined, various mechanisms, such as stepper motors or motor driven belts, are used to rotate the rollers at various speeds in order to move the sheet into proper alignment with the transport path. Various slippage between the sheet media and the rollers and the inevitable wear of the mechanical devices driving the rollers as well as the rollers themselves cause variations in the rotational speed of the placement rollers which, in turn, affect the actual correction or realignment of the sheet media with respect to the image producing device.

One of the most critical elements of this type of position alignment and correction is a system for measuring the actual location of the sheet media with respect to the transport path. In one configuration, an LED light bar is used in conjunction with a photosensitive bar. These two elements are placed one above and one below the transport path for the sheet media so that the sheet will pass between. Thus, the LED light bar and photosensitive bar are set perpendicular to the transport path. At predetermined time intervals, readings of the position of the sheet media are recorded which Identifies the actual position of the sheet media and whether it is skewed in relation to the center line of the transport path. This arrangement is quite expensive due to the costs of producing the LED light bar as well as the sensing bar. In fact, it is so expensive that the use of this type of position sensor has been substantially ignored.

The present invention addresses the limitations and problems which exist with the present type of sheet media alignment registration and de-skewing devices. The arrangement provided in the present invention and disclosed in this application is considerably cheaper and more reliable than those prior art devices. No attempt is made to actually move the sheet media, thus, eliminating the considerable number of electrical and mechanical devices which have been utilized in the past. As a result, the reliability and the accuracy of the present invention will considerably improve any printing process using the present correcting arrangement.

INFORMATION DISCLOSURE STATEMENT

The following statement is provided to comply with the applicant's acknowledged duty to inform the Patent and Trademark Office of any pertinent information of which he is aware. The following information refers to the most pertinent patents of which the applicant has knowledge with respect to the subject matter of the present invention. There is no intent to show that a comprehensive patent ability search has been performed on this subject.

In the Castelli, et al. patent (U.S. Pat. No. 5,887,996) a de-skewing and registering device for an electrophotographic printing machine is provided. A single sensor determines the actual position and the skew of a sheet in a paper path and generates a signal indicative of this position. A pair of independently driven nip rollers forwards the sheet to a registration position at a proper time based on signals from a controller which generates the motor control signals for applying the necessary corrections to reposition the sheet. An additional single photoelectric sensor can be used to provide feedback for updating the control signals for positioning the sheet.

The Uedo, et al. patent (U.S. Pat. No. 5,857,130) shows an image forming apparatus which has the capabilities of correcting a slant of the image which is recorded after the scanning of a document. The image signal is electrically processed so as to correct the slant of the image to be printed in a xerographic printing process.

The Fujikura, et al. patent (U.S. Pat. No. 6,273,418) discloses a sheet registration device which includes a sheet positioning member which is disposed along a side of the sheet transport path and parallel with the transport direction. Lateral moving rollers are provided for moving the sheet into contact with the side positioning member to register the sheet properly with respect to the image transferring device. Sensors are provided for identifying the position of the sheet and moving it accordingly into contact with the side positioning member. This arrangement properly aligns the sheet with respect to the transport path whereby the text from the imaging device will be positioned properly on the sheet.

The Nakamura, et al. patent (U.S. Pat. No. 5,458,324) allows detection of multiple sheets of paper being conveyed in an image reading or forming operation. In addition, a facility is provided for recovery to eliminate double or triple sheet feeding in the process. A pressure sensitive electrical conductive rubber roller is included which identifies when changes exist in the length and thickness of the sheet being conveyed. Electrical signals are produced so that multiple sheet conveying can be detected. This patent has nothing to do with the positioning of the sheet or identifying the position of the sheet in the transport path.

The Tanaka, et al. patent (U.S. Pat. No. 5,676,477) discloses a sheet carrying apparatus which is arranged for reducing the skew of a sheet in the transport path. Electrical and magnetic holding devices are disclosed in contact with the sheet as part of the holding device for positioning the sheet and correcting the skew. Position detecting devices are disclosed which primarily include an optical light sensing device on each side of the sheet transport path. Multiple readings as the sheet is transported provide output signals which are used to calculate the skew of the sheet. From this information, course determinations are produced for moving the sheet in proper position to eliminate the skew.

The Brookner patent (U.S. Pat. No. 6,234,694) is a device for printing postage or other images onto media of variable size. A detection device determines the size of the media in at least one dimension prior to or during the printing of the image. From the information received, the image is adjusted accordingly. As a result, the image printing facility is positioned to apply the image to the media in a proper location.

The Haselby patent (U.S. Pat. No. 6,241,334) discloses a technique for aligning the ink jet print head cartridge of an ink jet printer. The print cartridge moves along a horizontal carriage which is transverse to the transport path of the media. Optical sensors are supported on the movable carriage which read the horizontal positions of vertical test lines which are imaged on a detector in conjunction with horizontal alignment corrections of the media. In this way, alignment of the printed image is made possible.

The Kimura patent (U.S. Pat. No. 6,160,608) discloses an improved image recording apparatus which includes a recording light modulated in accordance with the image which is allowed to be incident in a specified recording position. Light sensitive material is transported in an auxiliary scanning direction as it is held in the recording position. The transport has a first nip transport device and a second nip transport device. The supply device for transporting the light sensitive material is supplied in an appropriate posture into the first nip transport device; any skew which is detected can be corrected in the position of the light sensitive materials upstream of the recording position without affecting the exposure thereby ensuring consistent production of photographic prints properly positioned on the light sensitive material.

SUMMARY OF THE INVENTION

The present invention is directed to a novel arrangement for sensing and measuring the position of sheet media as it is transported in a recording or printing operation. It is understood that this sensing device can be utilized with any type of printing operation and is not specifically limited to any one type.

As is well known, paper and other types of sheet media have a relatively high resistance with respect to the passage of an electrical current. The present sensing device utilizes this characteristic in determining the position and skew of the sheet media as it is being transported.

A pair of nipped rollers is positioned transverse to the longitudinal direction of the sheet media transport path. As is common in most devices of this type, the sheet media travels along the transport path at a known constant velocity. The rotating nipped rollers, according to the present invention, can include a solid metal roller which is usually positioned below the transport path with the corresponding parallel upper roller formed from a generally metallic support shaft having a thickness of electrically conductive rubber evenly applied thereto. Thus, it is possible to have a relatively thin diameter center shaft with a relatively thick coating of conductive rubber as the outer surface or a relatively large diameter metallic roller provided with a relatively thin coating of electrically conductive rubber forming the outer surface. In most cases, the thin coating of conductive rubber is desirable since it produces a lower resistance in the electrical circuit making up the sensing device. The mid-point of the conductive roller has an insulator which separates the roller into two substantially equal halves. The centered insulator position is aligned with the center line of the transport path of the printing device. The contact area for the pair of nipped rollers is a contact line or nip along the entire length of the rollers. A predetermined constant DC biasing voltage is applied to the metal roller and an electrical lead is connected to each half of the rubber conductive roller to provide output signals of the current passing through the conductive halves of the roller. Thus, without having any sheet material positioned in the nip or contact area of the rollers, the output current flowing through the electrical conductive halves will be equal. These output circuits can also be balanced for calibration purposes to maintain the output current in the idle condition as being equal. The output current from each half of the rubber conductive roller is fed to a position calculating circuit which can be part of a microprocessor contained within the printer device.

As stated earlier, paper and other types of sheet media have a relatively high electrical resistance. As the paper or sheet media is moved along the transport path, it is introduced into the electrically conductive rubber nipped roller and metal roller. The paper causes a change in the current flowing in the two halves of the nipped roller. These two output currents are measured and compared and an output signal is generated indicative of the proportion of the current flowing in each half of the nipped roller. This output signal indicates the exact position of the sheet material with respect to the center of the divided roller and, thus, the center line of the transport path. Multiple readings can be taken at predetermined time intervals as the sheet passes between the rollers with variations in the output signals being used to calculate the actual skew or lateral shift of the sheet media. The skew calculations, in the form of the output signals, are then passed directly to the processor for realignment of the image on the photosensitive drum or print head. Thus, the output signals precisely indicate the position of the sheet media and the skew or shift of the sheet media, if present. In this way, exact registration of the print image can be provided for each page of the sheet media.

As is well known, the processor within the printer device, such as a laser printer, receives the incoming digital data signals and scans a photosensitive drum which electrostatically transfers an image producing media, such as toner, to the sheet media as it passes along the transport path. The toner is transferred electrostatically to the sheet media where it is fixed by heat and pressure applied by a pair of fuser rollers.

The microprocessor in a laser scanning circuit applies the image directly to the photosensitive drum. Additional aligning circuitry can be provided in the processor for adjusting the position of the scanned image on the photosensitive drum in accordance with the skew or shift that has been identified for the individual sheet media upon which the image is to be placed. Thus, the position of the image is adjusted in accordance with the output signals received from the sheet media sensing device rather than the sheet media itself. In this way, the image as it is applied directly to the sheet media is registered properly with respect to the outer dimensions of the sheet. Through this very inexpensive and novel arrangement, image registration on the sheet media can be provided to produce a high quality printed page.

As stated above, it is possible to use this sheet media positioning sensor in any type of transport where a sheet media, such as paper, labels, or transparencies, can be properly printed with aligned text or images. This is true with any printing operation wherein the image transfer device is alignable with respect to the transport path of the media. This is not only true with a xerographic type of printer, such as a laser printer, but could be used with an ink bubble jet printer or a dot matrix printer, so long as the print head can be realigned with the determined position of the sheet media.

This has been a brief summary of the characteristics and benefits of a sheet media position sensing device according to the present invention. It is to be understood that other aspects and features of the present invention will become apparent from the following detailed description of the invention when it is considered in conjunction with the accompanying drawings.

DETAILED DESCRIPTION OF THE INVENTION

Figure 1:
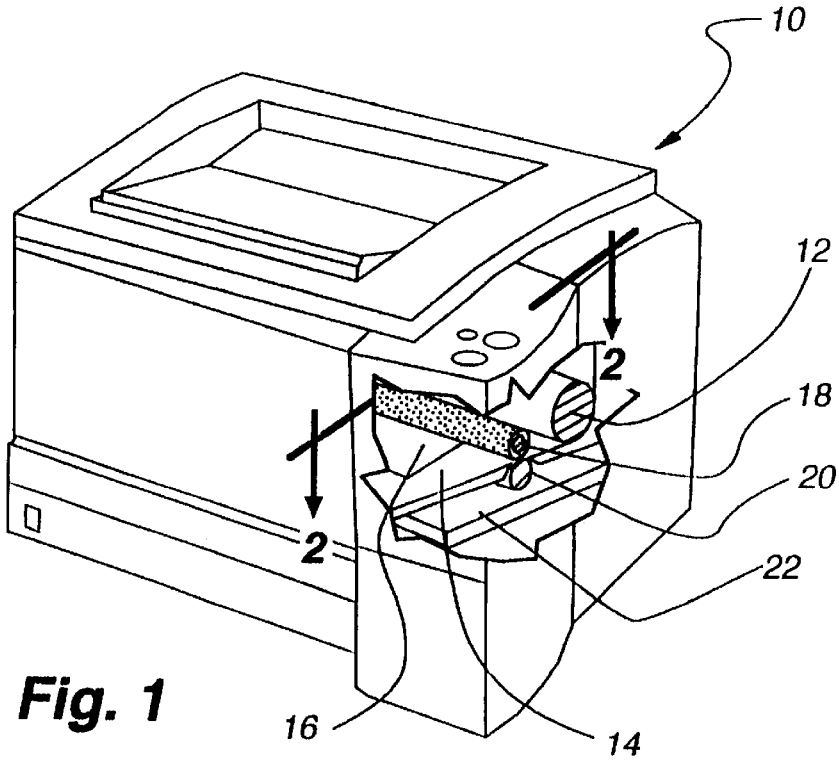
FIG. 1 is a projection view of a xerographic printer with a partial cutaway showing the sheet media passing between a pair of nipped rollers in a transport path to a photosensitive printing drum.

Turning now more specifically to the drawings, FIG. 1 shows a xerographic printer, such as a laser printer 10, with the side of the printer cut away showing the imaging drum 12, the sheet media transport path 14, a piece of sheet media, such as paper 16, and a pair of nipped rollers 18, 20. A receptacle drawer or tray 22 is positioned below the imaging section of the printer 10 and provides a repository for the sheet media where the individual sheets are picked up and routed through the transport path 14 for transfer of the image by the imaging drum 12. Although it is not shown, there is a pair of fuser rollers positioned downstream of the imaging drum 12 for permanently setting the toner transferred by the imaging drum to the sheet media. The fuser rollers use a combination of heat and pressure to melt the applied toner and permanently fuse the toner to the surface of the sheet media.

The sheet media tray 22 has mechanical guides or stops for properly positioning the sheet media in alignment with the transport path and the imaging drum. This is to say that the sheet media starts its travel along the transport path in a properly aligned position. Through wear and variations in forces moving the sheet media along the transport path, the individual sheets move out of alignment and usually become turned or skewed in relation to the center line of the transport path. This skew is inherent in many devices which use a transport path for moving sheet media, such as copiers, laser printers, ink jet printers, dot matrix printers, as well as scanners. It is to be understood that the present invention is directed to a device for sensing the actual position of the sheet media and allowing for correction of the position of the image to place the image properly in alignment with the surface and edges of the sheet media. As explained above, many of the prior art devices which address the problem of the skew of the sheet media attempt to return the sheet to its proper aligned position prior to the application of the image. This is directly in contrast with the solution to the problem provided by the present invention.

Figure 2:
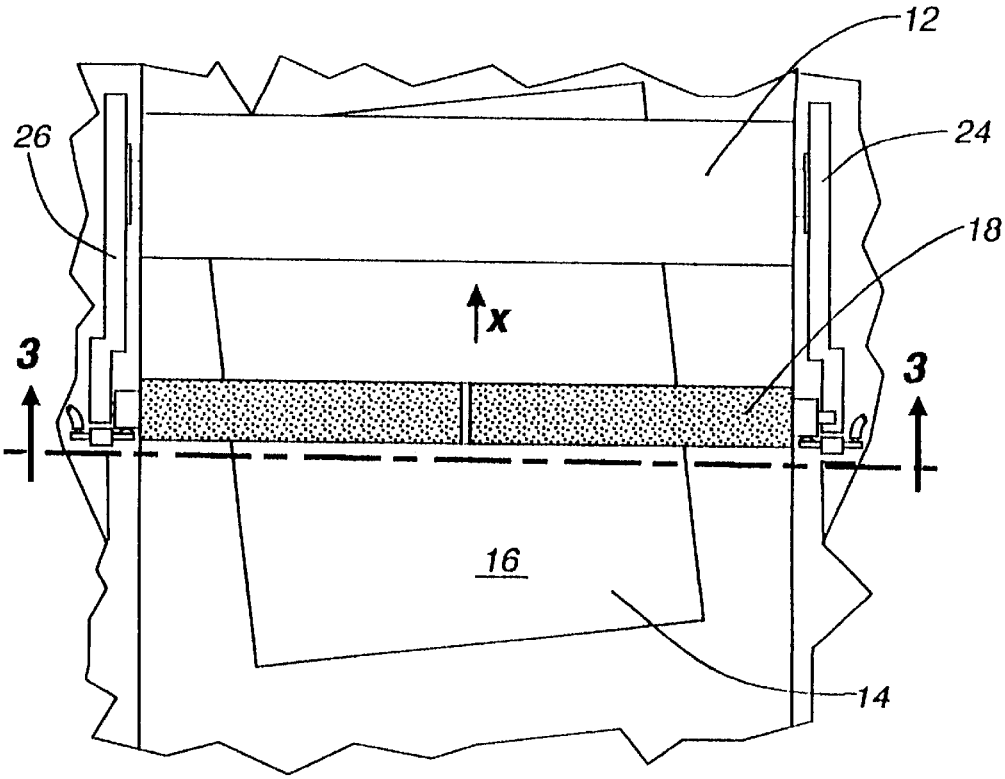
FIG. 2 shows a top plan view of the nipped rollers and photosensitive drum with respect to the sheet media in the transport path, according to lines 2—2 of FIG. 1.

FIG. 2 shows a partial top plan view of the transport path 14 and the laterally positioned photosensitive imaging drum 12. Nipped roller 18 and its corresponding opposed roller 20 are also positioned laterally across the transport path 14. Drive gears and belts 24, 26 are used to drive the imaging drum 12 as well as the nipped rollers 18, 20 and other rollers used in the transport path for moving the sheet media through the printing process. The rotational speed of the nipped rollers 18, 20 and the imaging drum 12 are coordinated so that the sheet media moves at a constant velocity along the transport path 14 in the direction of arrow X. Arrow X represents the movement of the sheet media and also the center line of the transport path and the corresponding anticipated center of the image.

As can be seen in FIG. 2, the media sheet 16 is not aligned properly with the center line of the transport path and the imaging drum 12. This misalignment is called a "skew" and represents the actual position of the sheet which can be not only shifted to the right or left of the center line (arrow X) or can be cocked so that the center line of the sheet is no longer parallel with the center line of the transport path. The purpose of the present invention is to sense the exact position of the media sheet and the timing of the movement of the sheet for entering the imaging process.

The sheet media as referred to in this application can be any relatively flat sheet material upon which an image can be printed. One characteristic of the material which is required by the present invention is that the sheet material has a relatively high resistance to the flow of an electrical current. In most cases and for the express purposes of the present invention, the sheet material can be paper, various types of plastics, transparencies, labels, decals or any other sheet material of this type which is moveable along a transport path. For illustration purposes, the remainder of this discussion will refer to paper as the sheet material. Any other suitable material can be substituted in this explanation.

Figure 3:
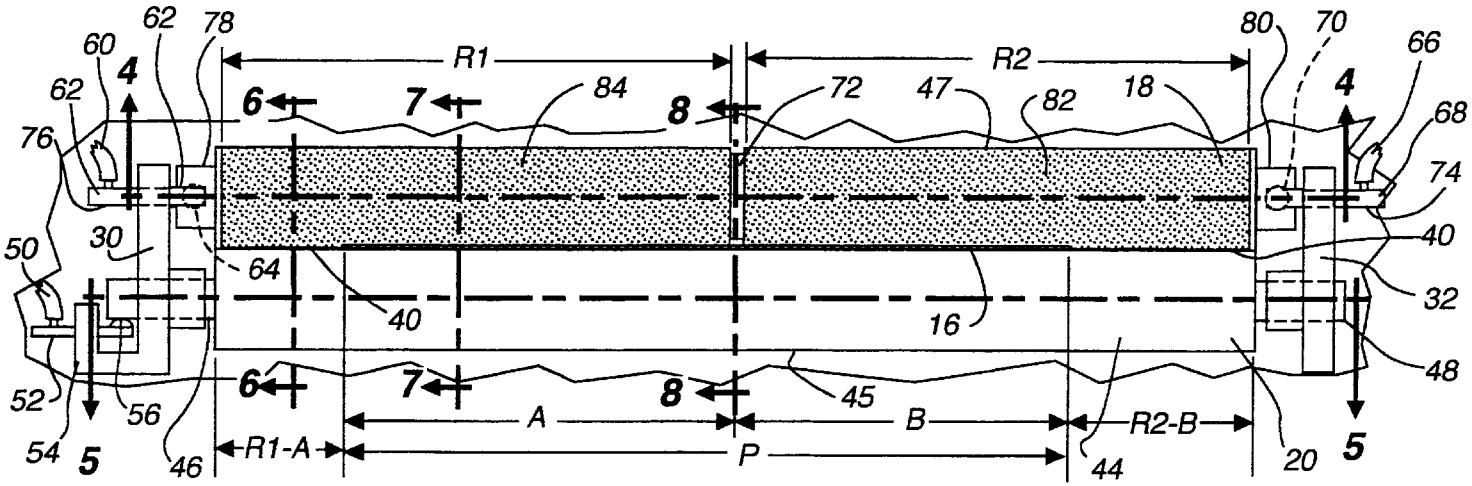
FIG. 3 is a partial side elevation view of the nipped roller pair, according to lines 3—3 of FIG. 2 showing a roller having a solid metallic surface and a roller having a resilient outer surface.

The nipped rollers 18, 20 are arranged transverse to the center line of the transport path 14 and are mounted by structural brackets 30, 32 which are part of the overall support structure of the laser printer 10. Drive devices 24, 26 can be arranged in tandem with the support brackets 30, 32 for driving the rollers 18, 20. The drive devices 24, 26 can be pinion and drive gears or belts which can transfer rotational power from a drive motor (not shown) to the photosensitive imaging drum as well as the nipped rollers. The nipped rollers 18, 20 can be supported on each end for rotational motion by the use of suitable sleeve bearings or other types of bearings to allow free rotation of the rollers. Although there are two drive mechanisms 24, 26 shown in the drawings, only one of these may be applied, if desired. It is also noted that there is an actual line contact between the nipped rollers 18, 20 which is referred to as the nip or contact area 40. As can be seen in FIG. 3, the individual rollers 18, 20 move in a counter rotation direction with respect to each other so as to move the sheet material along the transport path and into the photosensitive imaging drum 12.

The nipped roller 20 is formed from a solid metallic material, such as steel, aluminum or copper which has a surface with low resistance to electrical current flow. The nipped roller 20 has a relatively large diameter body 44 and shaft ends 46, 48 which are formed at opposite ends of the body, respectively. A conductor 50 connected to a suitable DC electrical input source is connected through a slide contact 52 to the roller 20. An upwardly extending arm 54 on the support member 30 can provide support for the contact 52. The contact 52 contacts the shaft extension 46 through a carbon brush 56 or other suitable contact device which will have low resistivity to the current flow from the conductor 50 through the shaft 46 and body 44 of the nipped roller 20.

Figure 4:
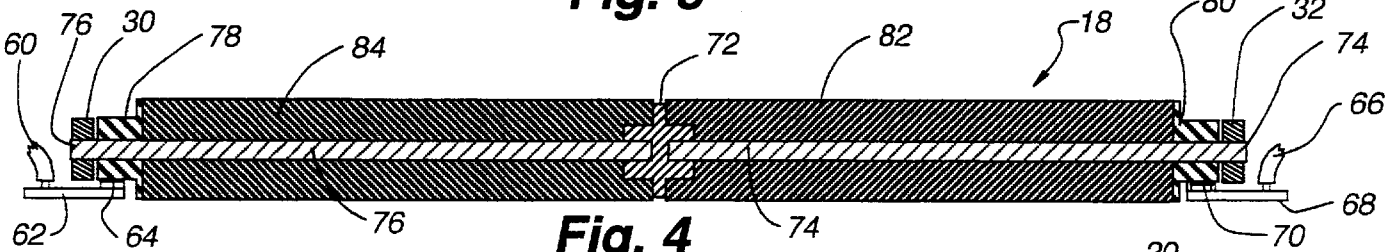
FIG. 4 is a cross-sectional view taken along the lines 4—4 of FIG. 3, showing an insulator at the mid-point of the resilient nipped roller.
Figure 5:
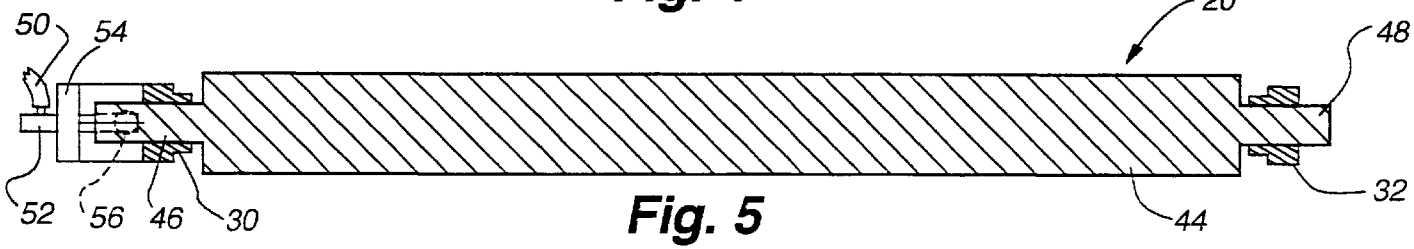
FIG. 5 is a cross-sectional view of the solid roller taken along lines 5—5 of FIG. 3.

As seen in FIG. 4, the complimentary nipped roller 18 has quite a different construction. The nipped roller 18 is made up of a pair of metal shafts 74, 76 which are coupled together in its mid-portion by a coupling 72. The coupling 72 is made from an electrical insulating material, such as wood, plastics or ceramics. The shafts 74, 76 are of equal length and the insulated coupling 72 is positioned in the center of the nipped roller 18. A pair of rubber sleeves 82, 84 which surround the shafts 74, 76 can be bonded to the shafts by a suitable electrical conductive adhesive. End caps 80, 78, respectively, are adhered to the exposed ends of the rubber sleeves 82, 84 and to the shafts 74, 76, respectively, to form an integrated nipped roller 18. The rubber sleeves 82, 84 are formed usually from a synthetic rubber material which includes an electrically conductive additive, such as carbon. The shafts 74, 76 and end caps 80, 78 are also formed from an electrical conductive material, such as steel, aluminum, copper or other low resistance materials. The ends of the shafts 74, 76 are suitably mounted in the support structures 30, 32 by electrically insulated bearings. Each of the rubber sleeves 82, 84 are of equal length and have a suitable total length in the assembled condition to span the transport path in which it will be installed. In addition, the overall length of the body for the nipped roller 20 is the same as the combined length of the rubber sleeves 82, 84 and the central insulator coupling 72. Thus, the nip or contact area 40 extends substantially the entire length of the nipped rollers 18, 20.

The right half of the nipped roller 18 including the rubber sleeve 82, shaft 74, and end cap 80 is electrically isolated from the left half comprising rubber sleeve 84, shaft 76, and end cap 78. An output conductor 66 attached through arm 68 and rubbing or sliding contact 70 is electrically connected to the end cap 80. In the same way, an output conductor 60 attached to conducting bar 62 and contact 64 is slidably connected to end cap 78 on the left half of the nipped roller 18. In this way, an electrical current can be fed through the conductor 50 and through shaft 46 to the surface 45 of the body 44 of the nipped roller 20. With the corresponding nipped roller 18 in line contact with the metal nipped roller 20 equal current will flow from the surface 45 of the nipped roller 20 through the surface 47 of the rubber conductive material in each half of the nipped roller 18 and through their respective conductors 60, 66. With just the two rollers 18, 20 in rotational contact, the output current from the conductors 60, 66 should be equal. If the currents in this condition are not balanced a suitable calibration circuit can be added for establishing equal current flow in each of the conductors.

A sheet of paper or other material is passed through the nip between the rollers. The width of the sheet must be less than the total length of the rollers and thus, the portion of the nip covered by the sheet material, which is an electrical insulator, will reduce the current flow in each half of the nipped roller 18 with the remaining current proportional to the remaining nip or line contact length between the nipped roller 20 and each half of the roller 18. The actual current flow from each half of the nipped roller 18 can be used to calculate the exact dimension of the remaining nip contact area on each half of the nipped roller 18. Thus, through these calculations the exact lateral position of the sheet media can be determined with respect to the center of the nipped roller 18 and thus, the center line of the transport path of the printer device.

Knowing the rotational speed of the nipped rollers 18, 20 and thus, the velocity of the sheet material passing between the rollers a plurality of current readings can be taken at predetermined timed intervals during the passage of the sheet material. These readings can be fed to a suitable calculating circuit to define the overall position of the sheet media; both in the lateral direction as well as the skewed position with respect to the transport path and the photosensitive imaging drum 12.

In order to calculate the current flow through each half of the nipped roller 18, it is necessary to determine the resistance that is present in the nip contact area between the rollers. In physics it is well known that the equation for Ohm's Law is $$\text{Current} = \frac{\text{Voltage}}{\text{Resistance}}$$

By the same token, it is possible to calculate the comparison of the resistances in the nipped contact area between the rollers 18, 20 by comparing the resistance of the two roller materials.

$$R = \text{Resistance} \quad \frac{R_{paper} = \rho_{paper} t_{paper}}{A_{paper}}$$

$$\rho = \text{Resistivity} \quad \frac{R_{rubber} = \rho_{rubber} t_{rubber}}{A_{rubber}}$$

$$t = \text{Thickness}$$

$$A = \text{Area}$$

We can calculate the parallel equivalent resistance as follows:

$$R_{equivalent} = \frac{1}{\frac{1}{R_{paper}} + \frac{1}{R_{rubber}}}$$

For the current in the sensing circuit to flow through the paper to the metal shaft of the two halves of the rubber coated nipped roller 18, it must pass in series through the paper and the rubber. Thus, the total resistance for the current flow in this path equals $$R_{paper} + R_{rubber}$$

$$R_{equivalent} = \frac{\rho_{paper} t_{paper}}{A} + \frac{\rho_{rubber} t_{rubber}}{A}$$

$$t_{paper} = 0.01 \text{ cm}$$

$$t_{rubber} = 5 \text{ mm} = .5 \text{ cm}$$

$$R_{equivalent} = \frac{10^6\ \Omega/\text{cm} \cdot 0.01 \text{ cm}}{A} + \frac{10^3\ \Omega/\text{cm} \cdot 0.5 \text{ cm}}{A}$$

$$R_{equivalent} = 1 \cdot 10^4\ \Omega/\text{cm}^2 + 5 \cdot 10^2\ \Omega/\text{cm}^2$$

As can be seen from the above result, the paper resistance is considerably larger by a factor of 20 over the rubber resistance. For this reason, the current in the circuit will flow from the voltage source, which is the surface 45 of the solid metal nipped roller 20 to the actual rubber surface 47 that remains in contact beyond the edges of the paper. Thus, a portion of the current will flow through the right half of the rubber coated nipped roller 18 and a portion through the left half, leaving substantially no current flowing through the area that is insulated by the sheet material 16.

FIG. 3 shows the left half 84 of the rubber nipped roller 18 whose length is designated as R1. The right half 82 of the rubber coated nipped roller 18 has a length designated as R2. The designation R1 and R2 represent the length of the nip on each half of the rubber nipped roller 18.

The width of the sheet material, such as a paper sheet, is designated as P. Since, in most cases, the width dimension of the sheet P will not be equally divided with respect to the center line of the nipped roller 18, the differences in the actual position of the paper with respect to the center line will be designated as the width dimensions A and B. The differences in these dimensions represent the lateral shift of the sheet with respect to the center line of the rubber coated nipped roller 18 and thus, the transport path of the sheet media. By subtracting the actual dimension A from the overall total length R1 of the left half of the roller, we have an actual length of R1 minus A, wherein the surface of the rubber coating of this half remains in actual contact with the surface of the solid metal nipped roller 20. By the same token, the actual exposed contact dimension on the right half of the rubber coated nipped roller 18 is designated as R2 minus B. The difference between the actual length of R1 minus A and R2 minus B identifies the actual lateral position of the sheet media 16. From the actual remaining contact area on each half of the rubber coated nipped roller 18, a specific current flow exists in each half based on the actual length of the contact line R1 minus A and R2 minus B. Since we know the resistivity of the rubber coating on the nipped roller 18 and the calibrated resistance of the circuitry for the two rollers, a comparison of the current flow from the two halves of the roller can precisely identify the remaining lateral dimensions and the position of the sheet material 16. In the same way, by taking periodic readings of the current flow at predetermined time intervals, as the sheet material 16 passes between the nipped rollers, the overall position of the sheet material can be determined. Thus, the sheet material can be identified as being offset laterally from the center line of the transport path or it can be skewed with respect to the center line of the transport path. This precise position information can be fed into the imaging circuit. Thus, the position of the image can be adjusted or realigned to register with the exact position of the sheet material as it passes adjacent to the surface of the photosensitive drum.

Figure 6:
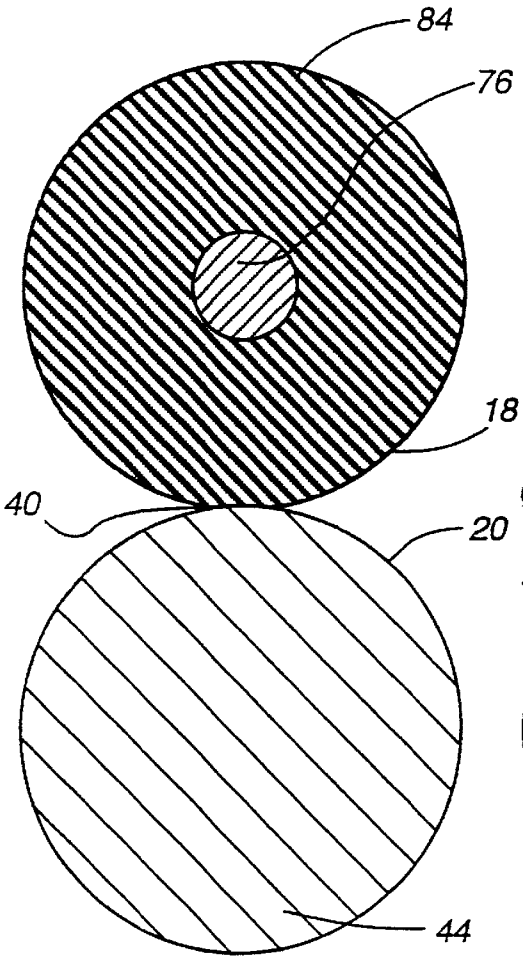
FIG. 6 is a cross-sectional view taken along lines 6—6 of FIG. 3, showing the position of the solid roller with respect to the resilient surface of the coated roller.
Figure 10:
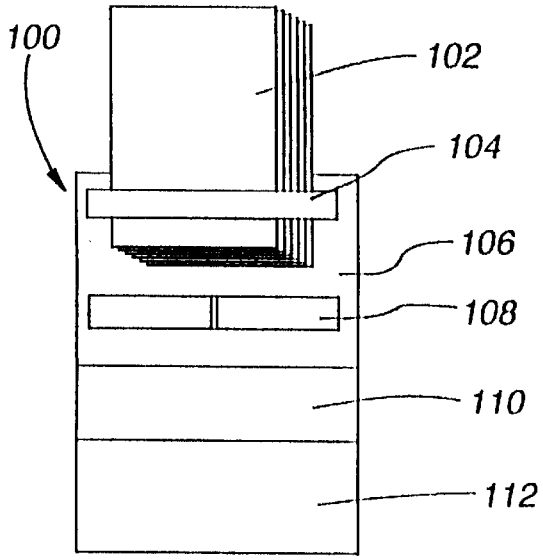
FIG. 10 shows a pictorial view of the relationship of the stacked sheet media with respect to the nipped roller position sensor device and the photosensitive drum.
Figure 11:
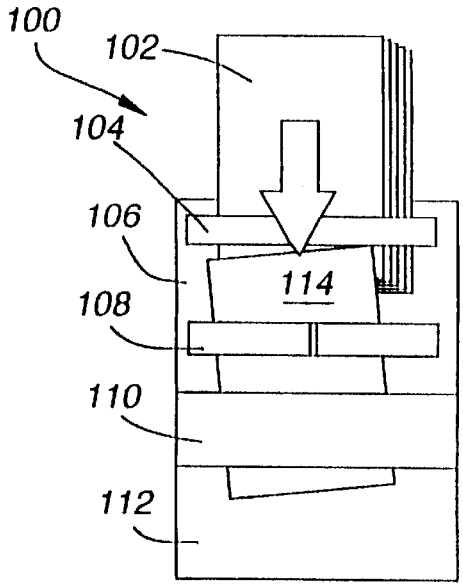
FIG. 11 is a pictorial view of the sheet media passing through the nipped roller sensor and photosensitive drum in a skewed position.

FIG. 6 shows the cross-section of the rubber coated nipped roller 18 in contact position with the solid metal nipped roller 20. As stated before, the actual contact line between the rollers 18, 20 is the nip or line area 40.

Figure 8:
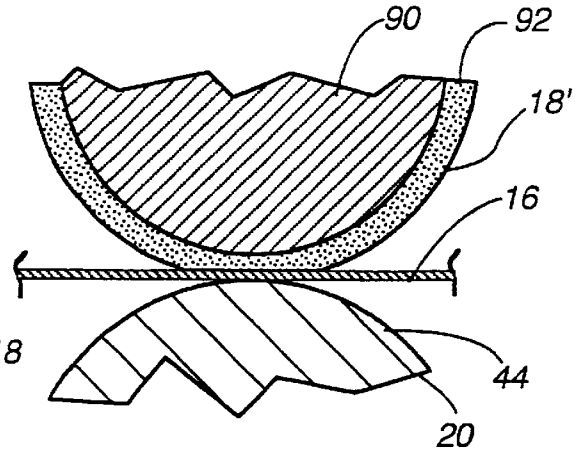
FIG. 8 is a cross-sectional view of the resilient nipped roller with the sheet media therebetween showing a thin rubber conductive coating on the roller.
Figure 7:
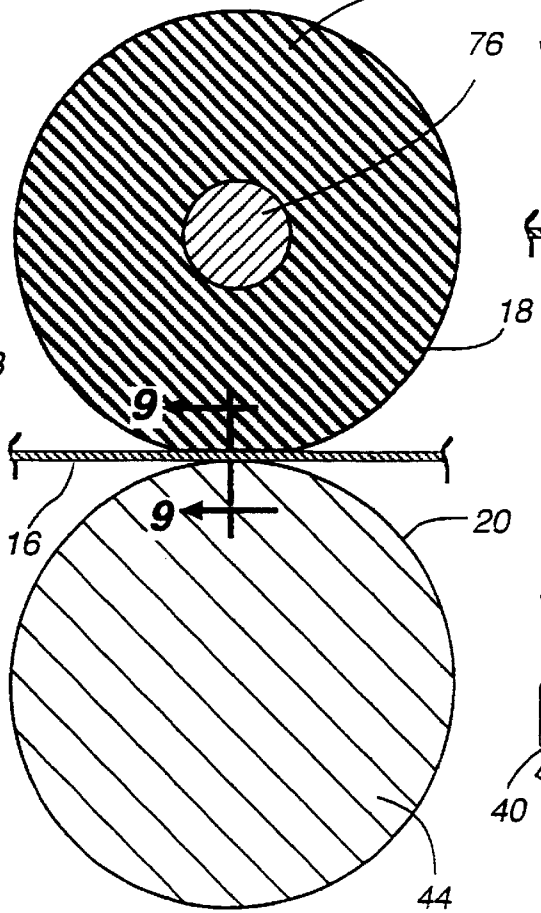
FIG. 7 is a cross-sectional view taken along lines 7—7 of FIG. 3, showing the position of the nipped rollers with sheet media therebetween.

FIG. 7 shows the sheet media 16 positioned between the rollers 18, 20 and partially insulating the electrical contact between surfaces of the rollers. In this figure, the rubber coated nipped roller 18 is shown having a relatively small shaft or axel 76 with a relatively thick coating of rubber 84. A more desirable embodiment might be the arrangement shown in FIG. 8 wherein again, the sheet media 16 is positioned between the rubber coated nipped roller 18' and the solid metal nipped roller 20. In this embodiment the nipped roller 18' has a relatively large metallic interior body or shaft 90 and a relatively thin coating of electrical conductive rubber 92. In essence, this is the embodiment upon which the calculations shown above were based.

Figure 9:
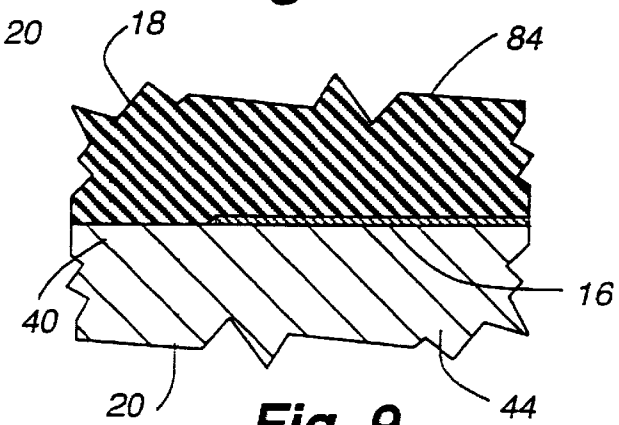
FIG. 9 is a partial cross-sectional view showing the edge of the sheet media between the contact surfaces of the nipped roller pair.

FIG. 9 again shows the solid metal portion of the nipped roller 20 and its relationship to the rubber coated roller 18 showing the position of the sheet media 16 and the actual remaining contact area between the two rollers which is the nip 40.

In another embodiment, the nipped roller 18 can be formed from a solid roller body formed from an insulation material, such as ceramics or plastic with a thin rubber conductive coating applied to the outer surface. The mid-point of the coating would have a narrow void or groove to form the two electrically isolated halves of the roller as explained above. Suitable slip connectors are provided on the outer ends of each of the halves for making the necessary electrical connection with the output conductors. It is also possible in the present invention to reverse the materials with respect to the nipped rollers 18, 20 described above. In this embodiment the solid roller could have a resilient coating while the divided roller could have a metallic surface on each electrically isolated half. In the alternative, both rollers could be coated with an electrically conductive solid or resilient material.

OPERATION

Figure 12:
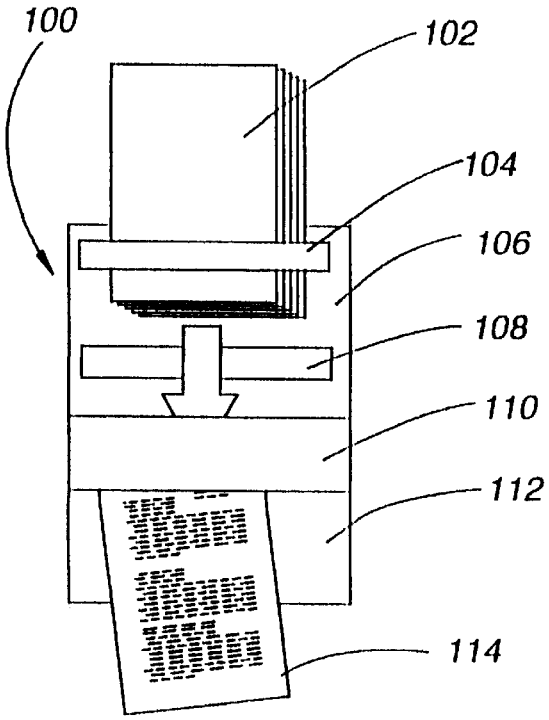
FIG. 12 is a pictorial view of the sheet media passing through the photosensitive drum with the text properly registered on the sheet media.

FIGS. 10–13 show the actual operation of an image printing device, such as a laser beam printer, and the relationship of the present invention with respect to the related transport path and the sheet media. The transport path 106 includes a tray or receptacle where a stack of sheet media, such as paper sheets 102, can be stacked for ready use. The tray is intended as a positioning device which aligns the stored paper in proper position with respect to the transport path. A document feeder roller 104 is positioned with respect to the tray and as needed the roller 104 feeds a single sheet of the paper onto the transport path 106. The sheet 114 passes through the pair of nipped rollers 108 according to the present invention. The position of the paper sheet 114 is continuously identified by the pair of nipped rollers 108 producing an output signal indicative of the lateral or skewed position of the paper sheet 114 with respect to the center line of the transport path 106. These output signals identifying the actual position of the sheet 114 are fed to a microprocessor which produces the digital image which is applied to the photosensitive imaging drum 110. The processor arbitrarily adjusts the actual position of the image according to the signals to register it properly on the photosensitive drum with respect to the actual position of the paper sheet 114 as it is fed into position with the imaging drum 110. Thus, as shown in FIG. 12, the actual image applied to the paper sheet 114 is properly registered on the sheet which compensates for the skew or lateral offset position of the sheet 114 as it is fed to the imaging drum 110.

Figure 13:
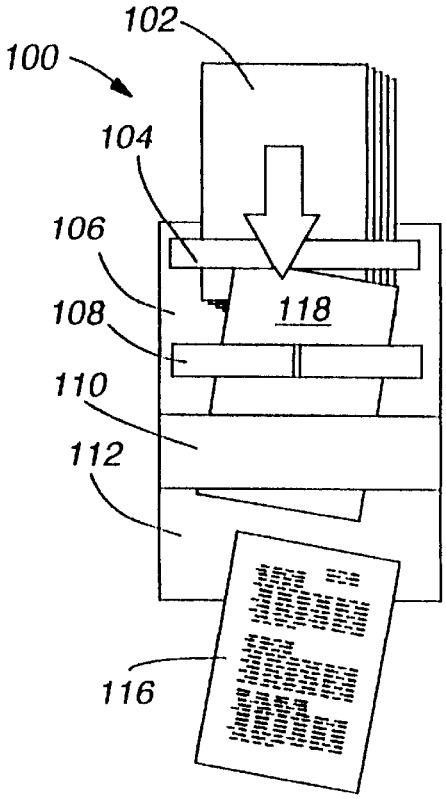
FIG. 13 is another pictorial view showing the sheet media in an opposite skewed position with a previous sheet showing the registered text imaging.

In the same context, as shown in FIG. 13, a paper sheet 116 which has been fed from the paper stack and tray 102 may be skewed in a different position by the document feeder roller 104 and this position is read by the nipped rollers 108 as the sheet 116 passes along the transport path 106. The position of this sheet is also determined and the position of the image again is compensated to apply the image correctly on the sheet 116. Paper sheet 118 is shown following sheet 116.

It is to be understood that the present invention is primarily intended for use with any device which allows for adjustment or compensation of an image to correspond with the actual position of the sheet media being fed to it. Usually the present invention will be used in combination with a device which applies an image to the sheet media and wherein the image itself can be skewed or repositioned so that the image will be applied to the sheet media corresponding to its actual position. In this way, a very inexpensive and precise compensation is available in the imaging process for obtaining high quality images on sheet media. The present invention can also be used with any device where the precise location or position of a sheet media traveling in a transport path is required to be known.

It is to be understood that materials have been designated throughout this application for the various components that have been described. Other materials can be substituted for those designated, so long as they provide the same characteristics and results as desired.

While an improved sheet media position sensor device has been described and illustrated in detail, it is to be understood that various changes and modifications to the invention may be achieved without departing from the spirit of the present invention.

I claim:

1. A sheet media position sensor for determining the position of sheet media with respect to a center line of a media transport path, the position of the sheet media being used to align an image transfer system so as to properly register and transfer an image to the sheet media, the position sensor comprising;

a) first and second, parallel, nipped rollers opposed laterally across a sheet media transport path;

b) said first roller having an electrical conductive surface;

c) said second roller having an electrical conductive surface, the surface of said second roller being insulated at its mid-point whereby the surface of the roller is divided into two relatively equal halves, said halves being electrically insulated from each other; the insulated mid-point of the second roller being aligned with the center line of said transport path;

d) the surface of said first roller being connected to a suitable electrical current source, the surface of each of the two halves of the second roller making a lineal contact area with the surface of the first roller whereby the electrical current can flow from the first roller through each half of the second roller, the current flow through each half being determined by the length of the contact area between said rollers; and e) an output signal means arranged to measure the current from each half of the second roller, calculate the lineal dimension of the contact area for each of the two halves, and generate output signals indicative of these dimensions so that when a sheet media having resistance to electrical current is passed between the rollers it will insulate a portion of the lineal contact area on each half of the second roller, thus reducing the current flow from each of the halves which is proportionate to the remaining contact area permitting the actual position of the sheet media with respect to the center line of the transport path to be determined.

2. A sheet media position sensor as defined in claim 1 wherein the electrical conductive surface of the first roller is formed from a solid material.

3. A sheet media position sensor as defined in claim 1 wherein the electrical conductive surface of the each half of the second roller is formed from a resilient material.

4. A sheet media position sensor as defined in claim 3 wherein the electrical conductive surface of each half of the second roller is formed from a synthetic rubber material having electrically conductive particles impregnated therein.

5. A sheet media position sensor as defined in claim 3 wherein the second roller has a thin resilient coating formed around a relatively thick metal shaft, said shaft and electrical conductive resilient coating is insulated at its mid-point to electrically isolate the two halves of the roller.

6. A sheet media position sensor as defined in claim 1 wherein a suitable electrical sliding contact means is provided for the input connection to said first roller and a suitable electrical sliding contact means is provided for the output connection from each of the halves of said second roller.

7. A sheet media position sensor as defined in claim 1 wherein the output signal means includes a processor for measuring the current flow and generating said output signals which are indicative of the position of a sheet media passing through said nipped rollers.

8. A method for sensing the position of an electrical resistive sheet media moving along a transport path having a center line in a processing device, the method includes the steps of:

a) positioning a pair of parallel nipped rollers laterally across a transport path for said sheet media, said nipped rollers being formed from an electrical conductive material and arranged to have a lineal contact area between said rollers;

b) dividing one of said rollers at its mid-point to form two electrically insulated halves and aligning the mid-point of said divided roller with the mid-point of said transport path;

c) connecting an electrical power source to the undivided roller and connecting an electrical output from each of said insulated halves;

d) passing an electrically resistive sheet media between said rollers which will reduce the length of the lineal contact area between each of the halves of the divided roller and the undivided roller;

e) measuring the electrical current from each half of the divided roller and determining the length of the remaining lineal contact area for each half which determines the actual position of the sheet media with respect to the center line of the transport path; and f) generating an output signal which is indicative of the position of the sheet media at the time that the reading is taken.

9. A method for sensing the position of a sheet media moving along a transport path as described in claim 8 which further includes the steps of, a) taking a series of measurements of the output current in each half of the divided roller at predetermined time intervals as the sheet media moves between the rollers along the transport path; and b) generating a series of output signals whereby the overall position of the sheet media can be determined and whether the sheet media is skewed with respect to the center line of the transport path.

10. A method for sensing the position of a sheet media moving along a transport path as described in claim 9 including the step of processing the output signals in an image transfer system to establish the position of the sheet media with respect to said image transfer system so that the transferred image can be adjusted to properly register the image with the sheet media.

11. An image aligning system for an image printing device wherein the image is aligned with a sheet media in a transport path which includes a center line whereby the image will be properly registered and printed on the sheet media during a printing operation, said sheet media having a relatively high electrical resistivity, the system comprising;

a) an image printing device in communication with a sheet media transport path, said printing device having a processing means capable of positioning and adjusting the image to be printed;

b) a pair of nipped parallel rollers arranged laterally opposed to the transport path so that the sheet media will pass between said rollers as it moves along said transport path to said printing device;

c) said pair of nipped rollers includes a first roller having an electrically conductive outer surface and a second roller having an electrically conductive outer surface which is separated circumferentially at its mid-point to form two insulated electrically conductive surface halves, the mid-point of said second roller being aligned with the center line of the transport path;

d) said first and second rollers being arranged to have a lineal contact area formed therebetween;

e) the surface of said first roller being connected to an input electrical source, each of said surface halves of said second roller having an electrical output which is related to the current flowing through the lineal contact area between the first roller and each of the halves of the second roller;

f) an output processor means for determining the resulting lineal contact dimensions for each half as an electrical resistive sheet passes between said rollers, said output processor generating an image position correction signal for the print processor which is indicative of the actual lateral position of the sheet media with respect to the center line of the transport path at the time that the signal is generated so that the print processor can align the image so that it will be properly registered with the sheet media as it passes through the printing operation.

12. An image aligning system as defined in claim 11 which further comprises means for rotating said first and second rollers to move said sheet material along said transport path, and said output processor means generates a plurality of image position correction signals which are produced at predetermined time intervals whereby the print processor can determine the overall position of the sheet media with respect to the center line of the transport path so that the image will be properly aligned and registered with respect to the sheet media.

13. An image aligning system as defined in claim 11 wherein the surface of each half of said second roller is formed from a thin coating of electrical conductive resilient material.

14. An image aligning system as defined in claim 13 wherein the resilient coating of the surface halves of the second roller is a synthetic rubber impregnated with carbon.

15. An image aligning system as defined in claim 11 wherein said first roller is formed from a metallic electrically conductive material.

* * * * *